US011401141B2

(12) United States Patent
Fiorese et al.

(10) Patent No.: US 11,401,141 B2
(45) Date of Patent: Aug. 2, 2022

(54) VEHICLE LIFTING EQUIPMENT

(71) Applicant: Francesco Fiorese, Albignasego (IT)

(72) Inventors: Francesco Fiorese, Albignasego (IT); Marta Fiorese, Albignasego (IT); Sara Fiorese, Albignasego (IT)

(73) Assignee: Francesco Fiorese, Albignasego (IT)

( * ) Notice: Subject to any disclaimer, the term of this patent is extended or adjusted under 35 U.S.C. 154(b) by 327 days.

(21) Appl. No.: 16/531,760

(22) Filed: Aug. 5, 2019

(65) Prior Publication Data

US 2020/0079629 A1 Mar. 12, 2020

(30) Foreign Application Priority Data

Sep. 6, 2018 (IT) ..... 102018000008382

(51) Int. Cl.
*B66F 7/26* (2006.01)
*B66F 7/06* (2006.01)

(52) U.S. Cl.
CPC ..... *B66F 7/26* (2013.01); *B66F 7/065* (2013.01)

(58) Field of Classification Search
CPC .... B66F 7/26; B66F 7/065; B66F 7/08; B66F 7/10; B66F 7/28; B66F 5/02; B21D 1/12; B21D 1/14
See application file for complete search history.

(56) References Cited

U.S. PATENT DOCUMENTS 1,914,286 A * 6/1933 Pice ..... B66F 3/08 254/98
4,404,838 A * 9/1983 Hare ..... B21D 1/14 72/457

(Continued)

FOREIGN PATENT DOCUMENTS

DE 29 06 960 A1 12/1979
DE 295 14 547 U1 10/1995

(Continued)

OTHER PUBLICATIONS

Italian Search Report in Italian Application 102018000008382, dated Apr. 26, 2019.
European Search Report in EP 19 18 9305, dated Jan. 15, 2020.

*Primary Examiner* — Joseph J Hail
*Assistant Examiner* — Timothy Brady
(74) *Attorney, Agent, or Firm* — Collard & Roe, P.C.

(57) ABSTRACT

Lifting equipment for repairing post-collision, damaged or under maintenance vehicles includes a central lifter having an upper platform/framework. Supports for lifting by the vehicle wheels are applied on side profiles of the upper platform/framework, or, alternatively, different supports for lifting by the vehicle underbody/underchassis using rubber pads. The supports for lifting by the wheels and by the underbody/underchassis are the same used to lift the vehicle directly by the wheels or alternatively by the underbody/underchassis, using a combination of high, low, or similar elements for support by the underbody/underchassis, between the supports for lifting by the wheels and by the underbody/underchassis and the underbody/underchassis of the vehicle, being the same supports for lifting by the wheels and by the underbody/underchassis applied in a removable/movable way to the upper platform/framework and movable by the operator along sides of the upper platform/framework and equipped with a device for adjusting their inclination.

13 Claims, 13 Drawing Sheets

(56) References Cited

U.S. PATENT DOCUMENTS

| | | | | |
|---|---|---|---|---|
| 10,611,016 | B1 * | 4/2020 | Riley | B25H 1/16 |
| 2008/0210915 | A1 * | 9/2008 | Ruan | B66F 1/06 254/95 |
| 2019/0224735 | A1 * | 7/2019 | Venalainen | B21D 1/14 |

FOREIGN PATENT DOCUMENTS

| | | | |
|---|---|---|---|
| DE | 29514547 | U1 | 10/1995 |
| EP | 1 468 755 | A1 | 10/2004 |
| EP | 1468755 | A1 | 10/2004 |
| WO | 93/15855 | A1 | 8/1993 |
| WO | WO2018046487 | A1 | 3/2018 |

* cited by examiner

VEHICLE LIFTING EQUIPMENT

CROSS REFERENCE TO RELATED APPLICATIONS

Applicant claims priority under 35 U.S.C. § 119 of Italian Application No. 102018000008382 filed on Sep. 6, 2018, the disclosure of which is incorporated by reference.

BACKGROUND OF THE INVENTION

Field of the Invention

The present invention relates to lifting equipment for the reparation of post-collision, damaged or under maintenance vehicles.

Description of the Related Art

As is well known, among the various types of lifting equipment used in body shops to allow the lifting of vehicles, so-called single-platform scissor lifts or similar are commonly used. This lifting assembly comprises, at the two sides of the vehicle support plane, a lifting/lowering scissor mechanism consisting of two pairs of levers reciprocally articulated at an intermediate section thereof and where the lever of each of the two pairs, more specifically the more external one, has its lower end hinged on the base plate, resting on the ground, and the upper end slidable below the supporting plane for lifting the vehicle, in a longitudinal direction, while on the opposite side, the two other levers, i.e. those placed more internally, have their lower end slidable on the aforementioned base plate and their upper end hinged under the aforementioned upper resting plane for lifting the vehicle.

The two pairs of levers that make up the two scissors are moved by at least one fluid-dynamic actuator having one end articulated on the crosspiece that connects the two lower ends of the two outer levers and the other end articulated, through an intermediate bracket, to the two upper arms of the two levers placed more internally.

The state of the art provides for the use of various types of lifters in body shops, which are mainly the following:

double-scissor lifters with movable platforms, called free-wheeled lifters because they lift the vehicle supported by the underbody/underchassis, so that the wheels of the vehicle itself are not resting on the lifter. These lifters are used to lift vehicles to perform interventions on the mechanical parts of the vehicle, which is supported by the underbody/underchassis by means of rubber pads supported directly by the movable platforms of the lifter and placed below the structure of the vehicle at the points indicated by the vehicle manufacturer. The drawbacks of these lifters, when they are used in body shop operations, are due to the fact that the movable platforms, protruding in width from the shape of the vehicle, occupy the lower side parts of the structure of the vehicle itself, thus they do not allow the operator to work on the devices of the vehicle located in these areas; moreover it is not possible to support the vehicle on the lifter by the wheels, since the lifter is not equipped with structures suitable for supporting the wheels, so that the operator, in order to be able to carry out certain assembly operations of the parts of the vehicle body that require the vehicle to be aligned, is forced to completely lower the lifter with the wheels of the vehicle in contact with the floor, because only in this way the vehicle is aligned such that its structure is not subjected to any bending of the frame or of the body;

lifters with two platforms with various types of scissor lifting devices or with jacks recessed into the floor. These lifters have movable platforms structured so as to allow the vehicle to rise with the wheels on the platforms, being able to free the wheels of the vehicle by means of a further lifting device integrated in the movable platforms for this purpose. These types of lifters are not normally used in body shops, because they have considerable overall dimensions and only allow access to the lower parts of the vehicle in a limited central area; in this way it is very difficult for the operator to approach the external and lower/side parts of the vehicle to carry out bodywork operations;

lifters with devices to support the vehicle by the wheels. These lifters have a single movable platform with a single lifting device and are particularly used for the repair of parts of the vehicle body, in which the devices for support by the wheels of the vehicle are applied to the movable platform, whereby the vehicle remains aligned, preventing the vehicle structure from being subjected to any bending of the frame or body. On the other hand, the vehicle lifted by the wheels does not allow the disassembly or assembly of some parts of the vehicle, especially those placed near the wheels, such as bumpers, mudguards, plastic body parts: operations for which it is sometimes necessary to remove the wheels;

lifters with a device for lifting the vehicle by the underbody/underchassis using supports, such as arms, with rubber pads, and in this way the wheels of the vehicle are not supported by the structure of the lifter itself. These lifters have a single moving platform, with a single lifting device, and are particularly used for the repair of parts of the vehicle body, in which the support devices for supporting the rubber pads are applied to the movable platform; the pads must be positioned at the points envisaged by the manufacturer; the lifting of the vehicle supported by the rubber pads allows the wheels to be left free, as in the case of double-scissor lifters with movable platforms, so-called free-wheel lifters; said rubber pads occupy a reduced part in the lower side parts of the vehicle but have the drawback that, when operations must be carried out which require no bending in the vehicle structure, it is necessary to completely lower the lifter with the vehicle wheels on the floor, thus forcing the operator to work in uncomfortable and tiring positions;

lifters with a vehicle support device by means of small benches for carrying out body-straightening operations on post-collision vehicles. These lifters, which are very widespread, are used to carry out small repairs on parts of the vehicle bodywork; they are widely used for small repairs because their reduced dimensions make them more compact and smaller compared to large benches, on which it is not economically convenient to carry out small repairs which currently constitute the majority of repairs that are carried out on post-collision vehicles; these small repairs are minor and therefore also the equipment for the reparation must be suited to needs and be quick to use, multifunctional and small in size. The latest generation small benches are of the low thickness type, so that the bottom of the vehicle is arranged above, so as to allow the vehicle to pass over the lifter during the positioning step on the lifter itself. Said small benches can be equipped with supports for lifting by the wheels, or supports for lifting by the underbody/underchassis fitted with a pad, depending on the type of intervention that must be carried out on the vehicle; the costs of these two pieces of equipment are disadvantageous, because they must both be comprised in the lifter equipment n order to be able to carry out all types of interventions and the operator must choose which device to use and how to use it; when the operator has decided which device to use, he must install it on the platform of the lifter, and when he has chosen to work for example with the supports for lifting by the wheels to carry out the task, if in the subsequent operation the wheels of the vehicle must be free, he is in fact forced to remove (if the weight requires it, also with the help of a second operator), the supports for lifting by the wheels, to install in their stead the supports for lifting by the underbody/underchassis with pads, in order to be able to lift the vehicle with free wheels; the time required to carry out these operations require a great effort by the operator. In short, the small benches, being of reduced dimensions and load capacity, have a use limited to small cars and are not suitable for lifting medium-sized vehicles, i.e. commercial vehicles, vans, SUVs, pick-ups and others;

lifters with a vehicle resting device by means of large benches for carrying out body-straightening operations on post-collision vehicles. These lifters consist of a frame, which has considerable dimensions with length and width lower, equal to or greater than the same vehicles to be repaired; these benches can be placed on the floor, or fixed on the upper part of the structure of a lifter that allows the bench itself to be raised at different heights and on which the clamps and the supports necessary to fix the vehicle to the bench are mounted in order to allow the use of pulling arms, devices adapted to tension and straighten the body and/or chassis of the post-collision vehicle. Obviously the large size of the bench does not prevent lifting also small or medium-sized vehicles, such as commercial vehicles, vans, SUVs, pick-ups and others. These large benches are divided into two constructive types, the first being a structure with dimensions in length and width equal to or greater than the vehicle to be repaired, while a second type has a central steel structure, to which the supports for lifting by the wheels are fixed but in which connection platforms are predisposed between the same supports for lifting by the wheels, so that during the vehicle positioning step on the lifter the same can slide above with the wheels; on both types of large benches drive-on ramps are provided, since the upper part of the bench has a height with respect to the floor that does not allow driving over it without these devices. As indicated above, the large benches allow lifting and repairing small and also medium-sized vehicles such as commercial vehicles, vans, SUVs, pick-ups and others, but the operation thereon is difficult, uncomfortable and tiring for the operator, requiring large amounts of time due to the need to handle many heavy parts of the equipment such as the drive-on ramps, in addition to the side connection parts between the supports for lifting by the wheels for driving over the bench, which at the end of the operations must then be disassembled to be able to intervene on the lower side parts of the vehicle to be repaired; when the wheels must be removed, the large benches are equipped with jacks that are placed between the bench and the vehicle or trestles that are placed on the ground and under the lower part of the vehicle so as to allow, by lowering the lift, the distancing of the wheels from the top of the bench in order to perform operations. In some cases, the large bench is equipped with a central lifter to obtain the distancing of the vehicle wheels from the resting plane, with a considerable increase in the overall costs of the equipment. For all these reasons the large benches and their equipment are of high cost, they do not reduce the time and effort required for the operator to carry out the operations, and ultimately, considering that the actual repairs are small compared to major repairs that are very rare because they are uneconomical. For this reason, the large benches are no longer convenient, due to the ever-increasing costs of vehicle parts. It should also be considered that even for small repairs on medium-sized vehicles such as commercial vehicles, vans, SUVs, and pick-ups, small lifters and the relative benches cannot be used, because they do not have the ability to lift vehicles of this size and weight, thus in order to carry out such repairs it is necessary to use the large benches, with additional costs and effort for the operator.

As an example of the lifts described above, the following patent documents are cited: WO2018046487, EP1468755, DE 29514547 and WO 93/15855.

The patent document WP2018046487 (in the name of the same applicant) describes vehicle pulling and anchoring equipment applied to a support for lifting by the Wheels.

The patent document EP1468755 describes a support for lifting by the wheels which allows freeing the wheel from the same support by means of an opening device. When the wheel is released, the car is fixed to the platform of the lifter/bench through a traditional system, which is independent of the support for lifting by the wheels, which comprises the clamp with the respective support for fixing to the platform, to keep the vehicle anchored when pulling arms are used.

SUMMARY OF THE INVENTION

The invention differs from the known types of devices in that it is possible to use the same supports for lifting the vehicle which have the possibility of performing the function of supporting the vehicle in a first manner by the underbody/underchassis of the vehicle itself, in combination with the elements for support by the underbody/underchassis, which are interposed between the vehicle and the support for lifting, in a second manner supporting the vehicle by the wheels. For this reason, the lifting support according to the invention, having a dual function, is called support for lifting by the wheels and by the underbody/underchassis.

The object of the present invention is to provide a lifter fitted with equipment for repairing post-collision, damaged or under maintenance vehicles, which is free from the drawbacks manifested by the products of the known type.

Specifically, the object of the invention is to provide an apparatus that improves the profitability of bodywork operations, which facilitates and makes the work of car body repairers more comfortable and at the same time allows performing operations comfortably and safely on small or medium-size vehicles such as cars, commercial vehicles, vans, SUVs, pick-ups and others, making it possible to pass from lifting the vehicle by the wheels to lifting the same with free wheels quickly and effortlessly, using the same lifting supports that can be moved along the upper platform/framework of the lifter, arranging the elements for support by the underbody/underchassis which are interposed between the lifting support and the lower part of the vehicle at the lifting points indicated by the vehicle manufacturer.

A further and noteworthy advantage of the invention in economic terms is the fact of providing equipment adapted to carry out all operations, whether small, medium or large, using a single lifter instead of various lifters envisaged for the specific operation, it is understood that the equipment according to the invention allows all operations to be carried out on a single lifter instead of using large benches, small benches and lifters without benches to carry out the same operations, including body repair and the maintenance of cars and medium-sized vehicles such as commercial vehicles, vans, SUVs, pick-ups and others.

In particular, the novelty consists in the application of equipment to the structure of lifters or benches that makes it possible, without the use of a plurality of devices, to lift the vehicle by the wheels or by the underbody, or by the underchassis, depending on the type of vehicle, or the type of work that must be done, in order to make the lifting operations of the vehicle in the various combinations quick and effortless, allowing the vehicle to be serviced and, if necessary, repair the body with the use of known fixing clamps and known pulling arms.

The new equipment according to the present invention provides for the use of a lifter, equipped with an upper platform or an upper framework of the bench, hereinafter referred to as the upper platform/framework, to which are removably/movably applied the supports for lifting by the wheels and by the underbody/underchassis, such that the vehicle can be lifted and lowered both with the wheels supported, and with the vehicle supported by the underbody/underchassis and with the wheels free, using various shapes of the elements for support by the underbody/underchassis in combination.

The supports for lifting by the wheels and by the underbody/underchassis are applied in a removable and movable way to the upper platform/framework of the lifter or of the bench and can be moved along the sides of the structure of the upper platform/framework itself.

The supports for lifting by the wheels and by the underbody/underchassis can support the vehicle directly by the wheels or the same in combination with various shapes of elements of support by the underbody/underchassis that can be high or low, and can support the vehicle by the underbody/underchassis with the wheels of the vehicle free. The low elements for support by the underbody/underchassis are mainly suitable for lifting cars, while the high elements are mainly suitable for lifting commercial vehicles, SUVs, pick-ups or others.

Said supports for lifting by the wheels and by the underbody/underchassis can be fixed to the upper platform/framework quickly by means of the specially provided fixing devices. In this way equipment can be applied to the supports for lifting by the wheels and by the underbody/underchassis to carry out the straightening operations of the body of the vehicle by means of a pulling/pushing arm and anchoring clamps. In summary, the equipment of the present invention allows obtaining the following advantages:

- practicality of having equipment that can be easily and quickly transformed to lift the vehicle by the wheels, or with free wheels;
- convenience of having the same supports for lifting by the wheels and by the underbody/underchassis to lift the vehicle both by the wheels and with the wheels free;
- less effort for the operator when passing from the arrangement of lifting to the use with supports for lifting by the wheels or by the underbody/underchassis with the wheels free, since in the actual work steps of bodywork repairs, and also for those future ones, it is necessary to pass within the same repair from lifting with free wheels (for example for the assembly of the parts under the wheel when it is necessary to remove the wheels), to the successive steps when the vehicle must be supported by the wheels in order to avoid the bending of the body or chassis of the vehicle, which occurs due to the weight of the mechanical parts, engine, gearbox, etc., when the vehicle is lifted on the points of the body with the wheels free.
- practicality of work because when using a lowered type of lifter, which has minimum dimensions in height, on which the supports for lifting by the wheels and by the underbody/underchassis are installed which in turn are of a low profile, for the minimum overall height when the lifter is lowered to the ground, cars or other vehicles can drive over the lifter without the use of drive-on ramps and connecting platforms to slide the vehicle over the lifter, as is the case on large benches, where to drive over the lifter with medium-sized vehicles, SUVs, pick-ups and others drive-on ramps and connecting platforms must be used;
- practicality and ease of use, since the supports for lifting by the wheels and by the underbody/underchassis can be moved along the sides of the structure of the upper platform/framework by a single operator, using the handle-shaped tube specially provided on the structure of the support for lifting by the wheels and by the underbody/underchassis;
- safe use because the combination of the supports for lifting by the wheels and by the underbody/underchassis with the low or high elements for support by the underbody/underchassis ensure vehicle stability also in the presence of vehicles with non-coplanar underbody/underchassis support points;
- practicality and convenience of having the possibility of using supports for lifting by the wheels and by the underbody/underchassis in combination with elements for support by the underbody/underchassis in various combinations such as, by way of example, two supports for lifting by the wheels and by the underbody/underchassis to lift a pair of vehicle wheels and two elements for support by the underbody/underchassis to support the vehicle by the underbody/imderchassis with the corresponding vehicle wheels free;
- simplicity and precision of parallelism adjustment of supports for lifting by the wheels and by the underbody/underchassis thanks to the presence of a setting device applied on each support for lifting by the wheels and by the underbody/underchassis which allows obtaining a horizontal plane parallel to the resting surface of the lifter, necessary when repairs are to be carried out on medium-sized and weight commercial vehicles, SUVs, and pick-ups, which require a large upper platform/framework and correct adjustment and parallelism.

Technically, the lifter for body shops, designed for the reparation of post-collision, damaged or under maintenance vehicles, has a resting base on the ground, two pairs of levers of which one pair is hinged to the other pair, forming a pantograph structure, at least one hydraulic jack, an upper platform/framework on the long parallel sides of which four supports for lifting by the wheels and by the underbody/underchassis are normally applied (in vehicles with six wheels a corresponding number of lifting supports will be provided). Said supports for lifting by the wheels and by the underbody/underchassis are used to lift the vehicle by its own wheels or by the underbody/underchassis depending on the operational needs of having some or all of the vehicle wheels free.

The lifting of the vehicle with free wheels is obtained by means of elements for support by the underbody/underchassis, which are positioned on the same number of supports for lifting by the wheels and by the underbody/underchassis and are provided with an intermediate body wherein a thread is formed in which a pin is screwed to obtain the desired height and on the upper part of which a device is provided fitted above with a layer of slip-proof material, preferably rubber, to support the vehicle by the underbody/underchassis; said elements for support by the underbody/underchassis are each positioned on a support for lifting by the wheels and by the underbody/underchassis by means of one or more devices applied to the lower part of the intermediate body and provided with a thickness of slip-proof material, preferably rubber.

The elements for support by the underbody/underchassis can be made in various constructive forms: high, low. One constructive form envisages two or more legs, each equipped with one or more points positioned on the support for lifting by the wheels and by the underbody/underchassis, making it possible to obtain a solid and secure support for the vehicle.

In a further constructive version the length of one or more legs can be varied by means of a settable device. In this way, when the transverse dimensions of the vehicle are reduced (vehicles with a narrow frame), the setting of the leg length allows obtaining a solid and safe placement even on different planes.

The support for lifting by the wheels and by the underbody/underchassis is designed to support, if necessary, an element to which pulling and anchoring equipment is fixed.

BRIEF DESCRIPTION OF THE DRAWINGS

Further advantages and characteristics of the invention will become clearer from the description of a possible embodiment thereof, given solely by way of non-limiting example, with the aid of the attached drawings, wherein.

DETAILED DESCRIPTION OF PREFERRED EMBODIMENTS

Figure 1:
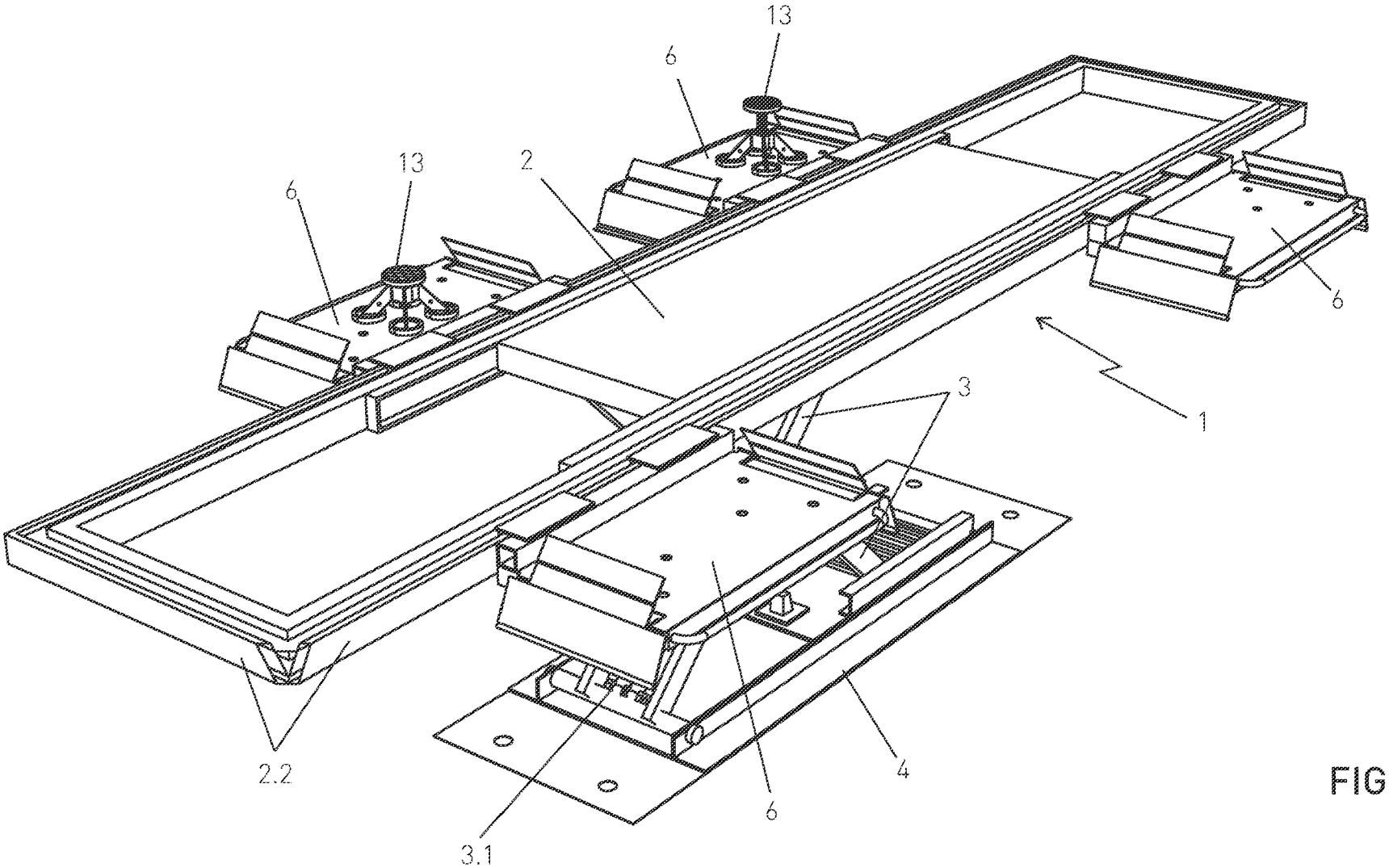
FIG. 1 shows a perspective view of the lifter 1, in the raised position, for the reparation of post-collision, damaged or under maintenance vehicles with the application of supports for lifting by the wheels and by the underbody/underchassis 6, two of which are represented on one side in an enlarged position to support the vehicle by the respective wheels, the remaining two on the opposite side in a narrow position to support two elements for support by the underbody/underchassis 13 for lifting the vehicle by the underbody/underchassis with free wheels.

FIG. 1 shows the lifter for the reparation of post-collision vehicles according to the invention comprising the four supports for lifting by the wheels and by the underbody/underchassis 6 removably applied to the upper platform/framework 2 of a lifter 1, wherein the lifting/lowering movement of the upper platform/framework 2 is obtained by means of a lifting mechanism 3, which comprises, at each of the two longitudinal sides of said upper platform/framework 2, a lifting mechanism 3 consisting of two pairs of levers articulated to each other, of which two parallel levers placed more externally, equipped at the upper end with casters sliding inside the upper platform/framework 2 and the lower end hinged with a pin to the base 4, while the two parallel levers placed internally are equipped with hinges at the upper end thereof, placed inside the upper structure of the upper platform/framework 2, while they are equipped at the lower end with sliding casters at ground level, along a trajectory concordant with the longitudinal axis of the base plane 4. The entire lifting mechanism is activated by a fluid-dynamic actuator 3.1, which has its lower end articulated on the pair of levers placed more externally, while the upper end acts on the pair of levers placed more internally by means of a device that favors the starting point at the beginning of the lifting step so as to obtain a minimum size when the lift is lowered.

Figure 2:
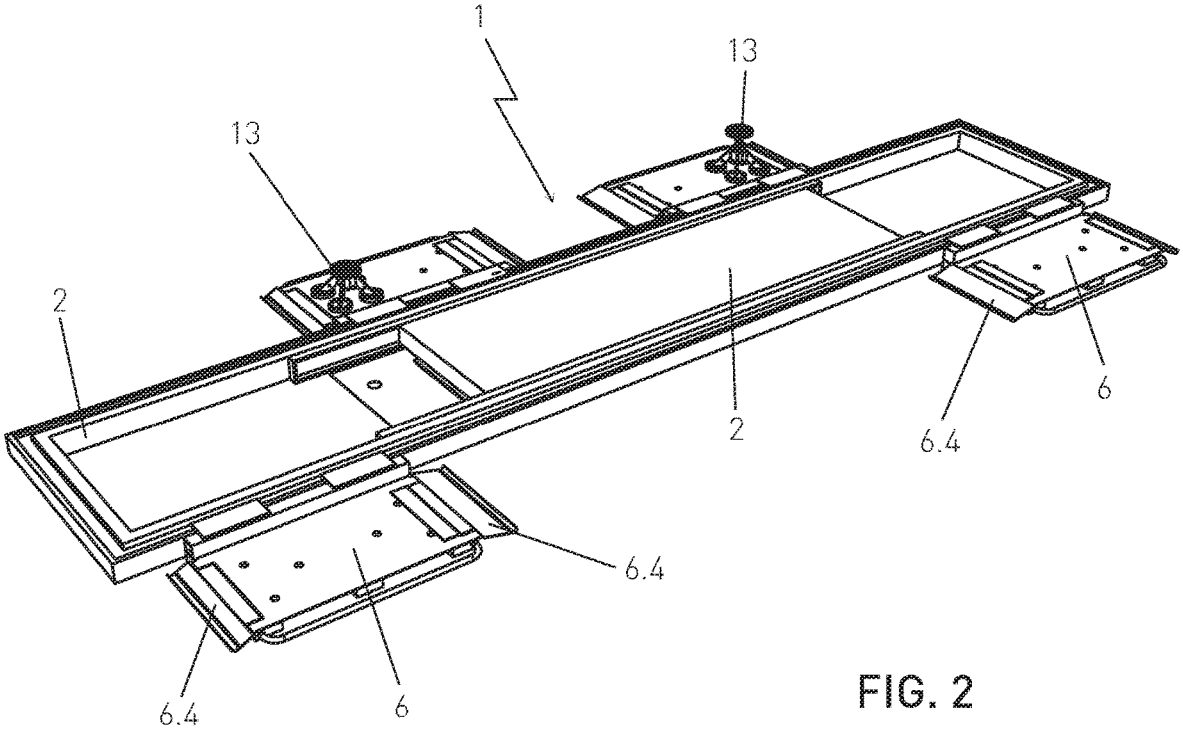
FIG. 2 shows a perspective view of the lifter 1 for the reparation of post-collision, damaged or under maintenance vehicles in a completely lowered position with the supports for lifting by the wheels and by the underbody/underchassis 6, two of which are shown on one side in an enlarged position to support the vehicle by the respective wheels, the remaining two on the opposite side in a narrow position for resting two elements for support by the underbody/underchassis 13 for lifting the vehicle by the underbody/underchassis with free wheels.

FIG. 2 shows the lifter for the reparation of post-collision vehicles in a completely lowered position with the supports for lifting by the wheels and by the underbody/underchassis 6; note the reduced overall height thanks to which the vehicles pass above the lifter, since the width of the lifter 1, complete with the upper platform/framework 2 is less than the minimum width of the inside of the wheels also of smaller cars, characteristics which make the positioning and lifting of the vehicle quick and easy. The supports for lifting by the wheels and by the underbody/underchassis 6 are also shown, of which two widened in a lifting position on wheels and two on the central opposite side equipped with elements for support by the underbody/underchassis 13 for the lifting by the underbody/underchassis with free wheels.

Figure 3:
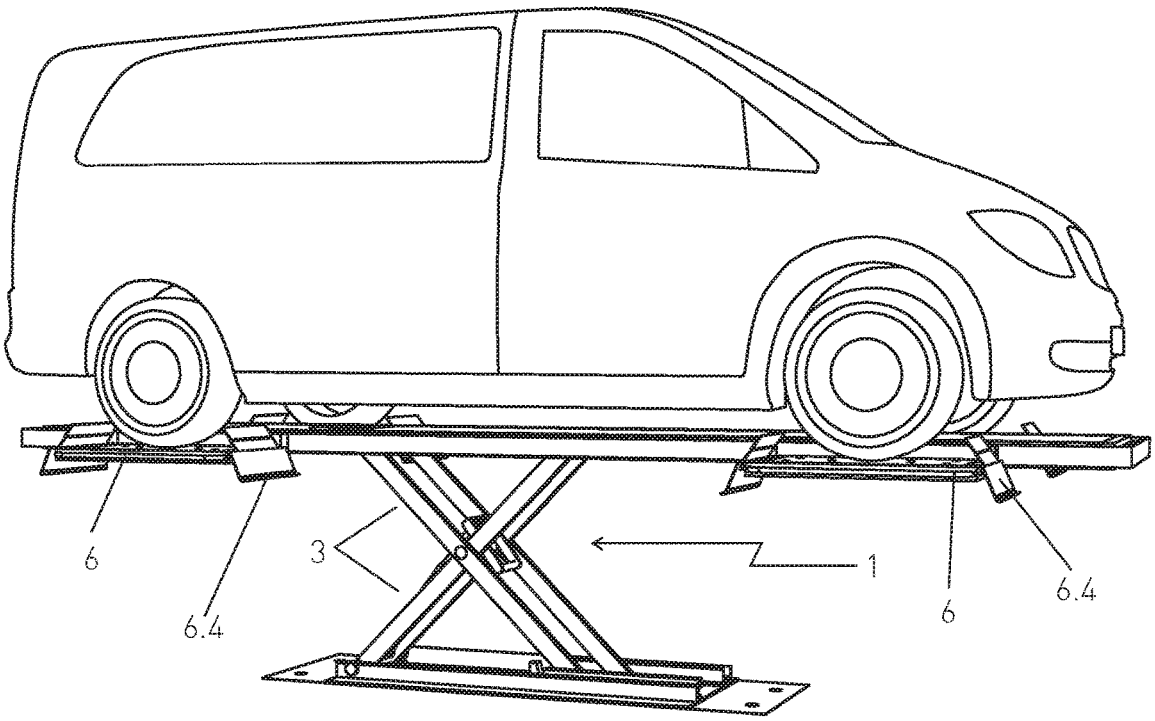
FIG. 3 shows a perspective view of the lifter 1 for the reparation of post-collision, damaged or under maintenance vehicles in the raised position with a vehicle resting on the wheels by means of the supports for lifting by the wheels and by the underbody/underchassis 6.

In FIG. 3 the lifter for the reparation of post-collision vehicles is shown in a raised position with a vehicle on-board supported by the wheels by means of the supports for lifting by the wheels and by the underbody/underchassis 6, in which the minimum size of the supports for lifting by the wheels and by the underbody/underchassis 6 with respect to the lifter 1 can be seen, which allows the operator to comfortably intervene in the lower front and side parts of the vehicle body.

Figure 4:
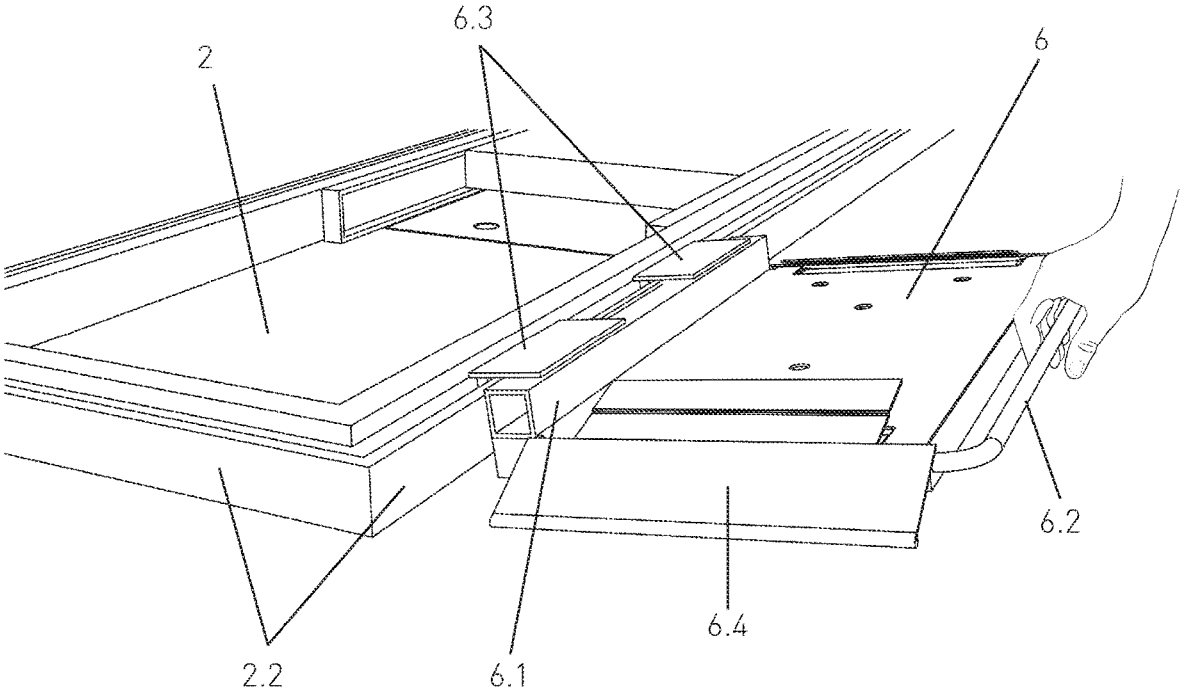
FIG. 4 shows a perspective view of the support for lifting by the wheels and by the underbody/underchassis 6 with the external handle 6.2 for moving and adjusting the support for lifting by the wheels and by the underbody/underchassis 6 along the side profile 2.2 of the upper platform/framework 2.

FIG. 4 shows the support for lifting by the wheels and by the underbody/underchassis 6, in which the handle 6.2 can be seen, which is used to move the supports for lifting by the wheels and by the underbody/underchassis 6 along the upper platform/framework 2. The same FIG. 4 also shows the tubular profile 6.1 which is part of the structure for supporting and lifting by the wheels and by the underbody/underchassis 6 and the protections 6.4 which prevent the wheel from rolling when the vehicle is raised.

Figure 5:
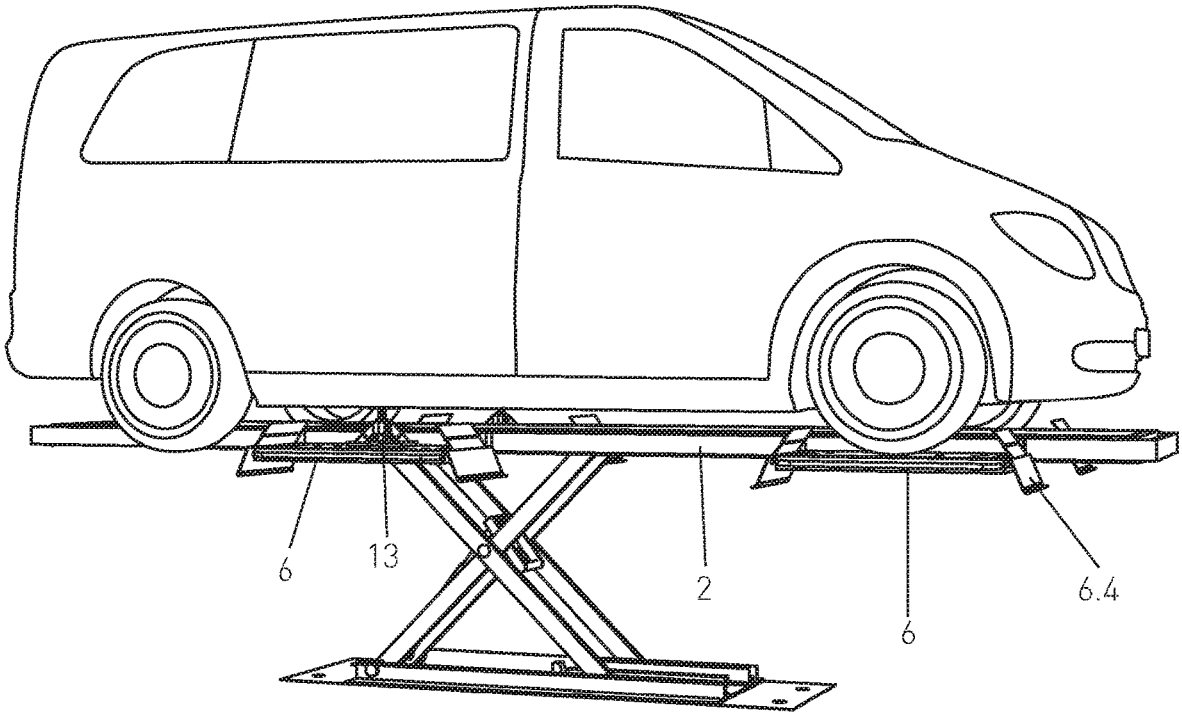
FIG. 5 shows a perspective view of the lifter 1 in a raised position with a vehicle supported by the underbody, using two high elements 13 for support by the underbody/underchassis, interposed between the vehicle underbody and the supports for lifting by the wheels and by the underbody/underchassis 6, near the rear axle of the vehicle and two supports for lifting by the wheels and by the underbody/underchassis 6 that support the vehicle by the two wheels of the front axle.

The lifter can be seen in FIG. 5 in a raised position with a vehicle supported by the underbody/underchassis, using two high elements 13 for support by the underbody/underchassis, interposed between the vehicle underbody and the supports for lifting by the wheels and by the underbody/underchassis 6, while two wheels of the vehicle are supported by two supports for lifting by the wheels and by the underbody/underchassis 6.

Figure 6:
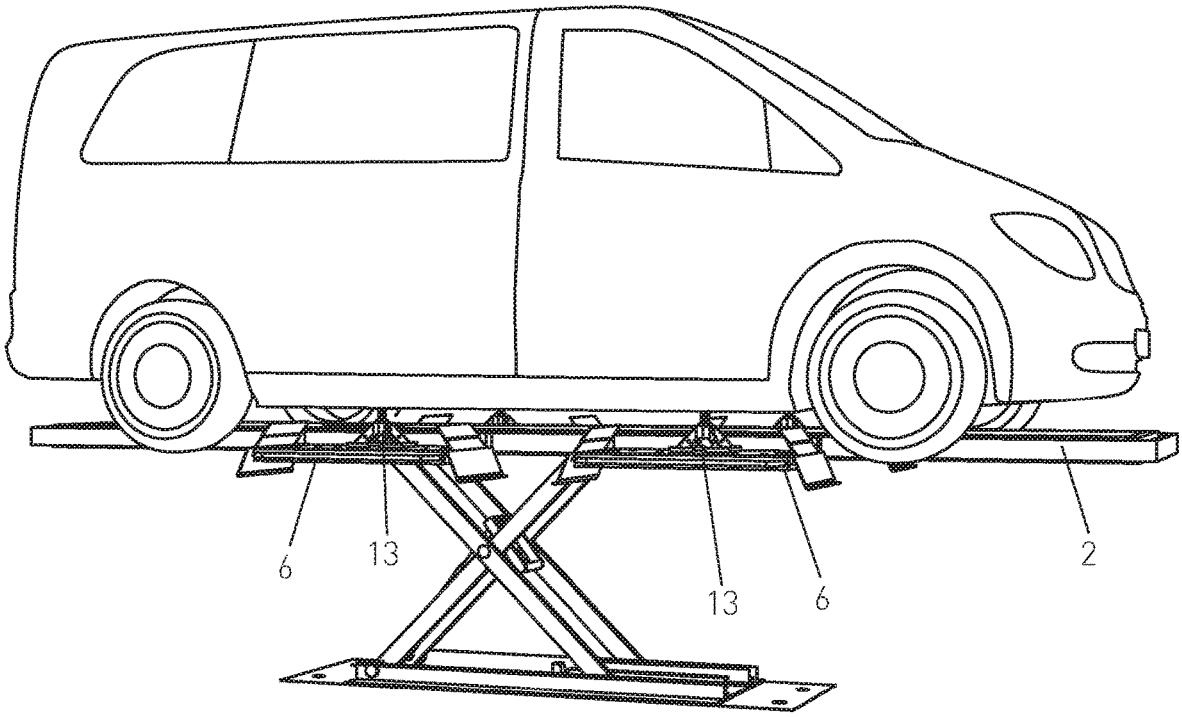
FIG. 6 shows a perspective view of the lifter 1 in a raised position with a vehicle supported by the underbody, using the high elements 13 for support by the underbody/underchassis, placed between the vehicle underbody/underchassis and the supports for lifting by the wheels and by the underbody/underchassis 6.
Figure 7:
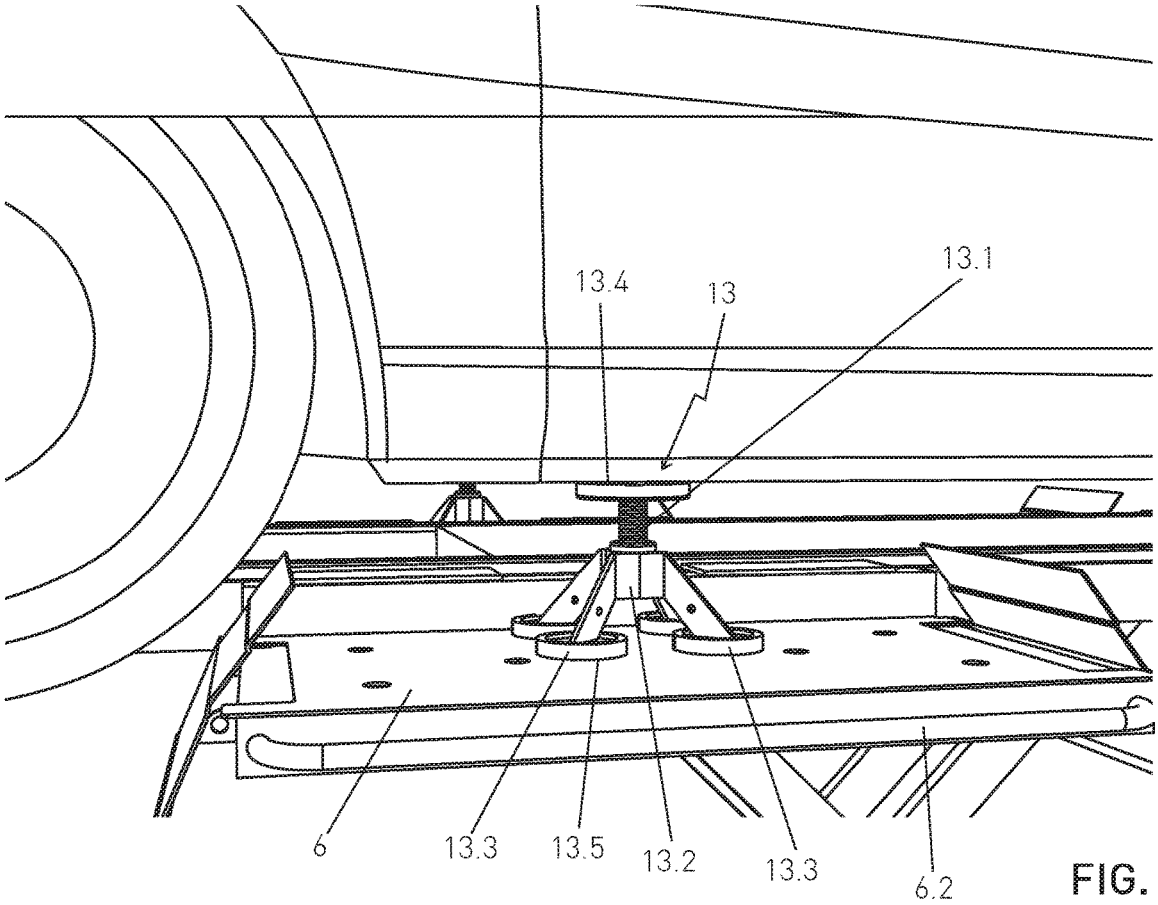
FIG. 7 shows a perspective view of a high version 13 of the element for support by the underbody/underchassis, in a particular constructive variant, equipped with a body 13.2 with four legs, positioned between the vehicle lifting point and the support for lifting by the wheels and by the underbody/underchassis 6.

FIGS. 6 and 7 show the vehicle lifted by the underbody/underchassis by means of high elements 13 for support by the underbody/underchassis, positioned above the support for lifting by the wheels and by the underbody/underchassis 6; said high elements 13 for support by the underbody/underchassis are equipped with an intermediate body 13.2, threaded internally on which a pin 13.1 is screwed in order to adjust the working height, equipped above with a device on which a layer of slip-proof material 13.4 is applied, preferably rubber, which supports the vehicle by the underbody/underchassis; said elements for support by the underbody/underchassis 13 are each in contact with a support for lifting by the wheels and by the underbody/underchassis 6 by means of one or more elements 13.3 applied to the lower part of the intermediate body 13.2 and fitted with a thickness of slip-proof material 13.5, preferably rubber. FIGS. 6 and 7 show the space existing between the lower part of the vehicle and the upper part of the upper platform/framework 2, which makes interventions on the vehicle comfortable and easy even in the areas on the parts near the wheels.

Figure 8:
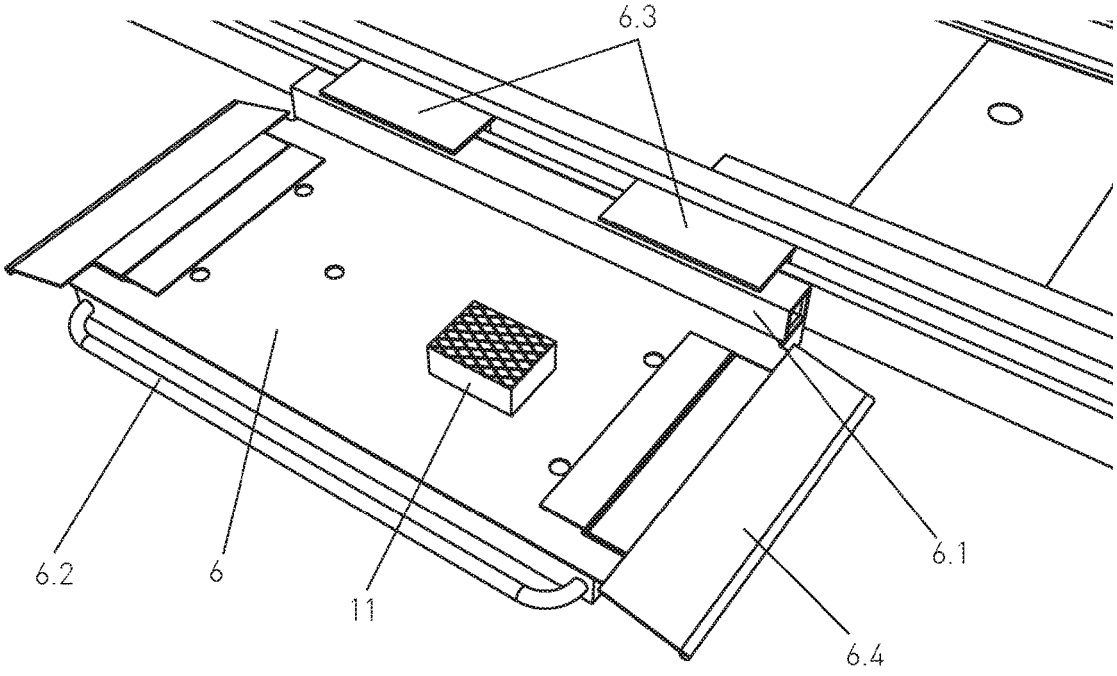
FIG. 8 shows a perspective view of the support for lifting by the wheels and by the widerbody/underchassis 6 in a constructive version wherein the element for lifting by the underbody/underchassis of the vehicle is obtained with a support element of a simpler shape 11.
Figure 9:
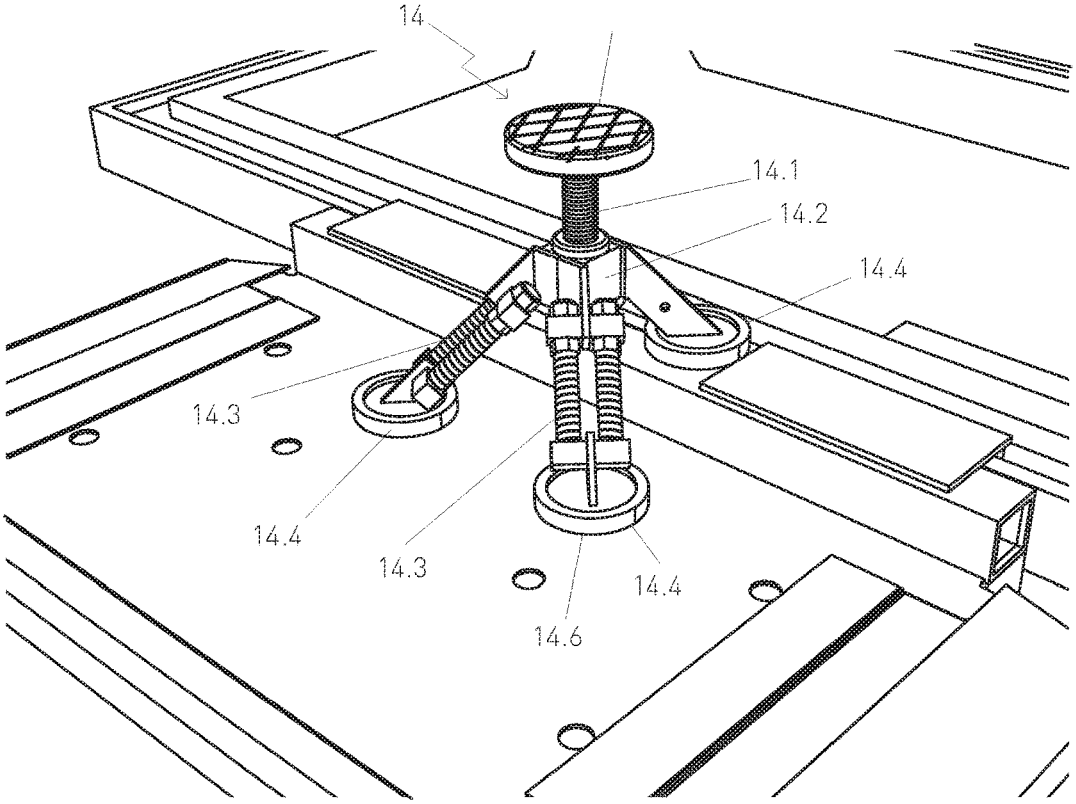
FIG. 9 shows a perspective view of a high type of element for support by the underbody/underchassis in a constructive variant consisting of four legs of which two 14.3 are adjustable in length.
Figure 10:
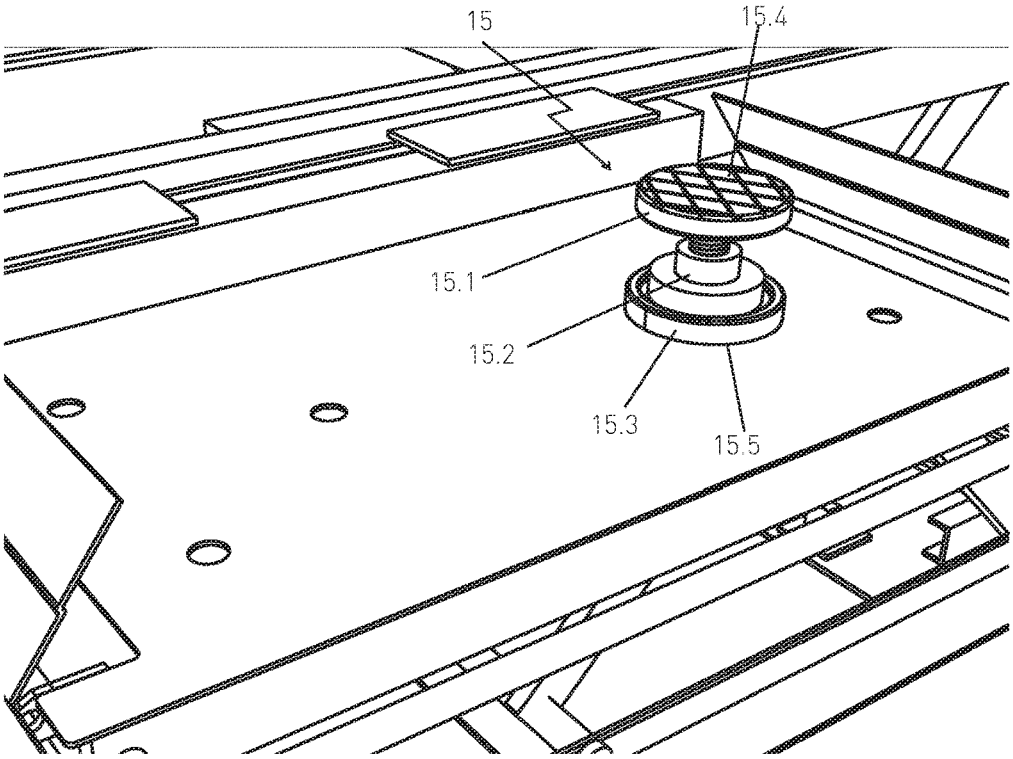
FIG. 10 shows a perspective view of a low type 15 of element for support of the underbody/underchassis in a constructive variant consisting of a threaded pin 15.1, fitted with a support with the threaded pin screwed into the intermediate body 15.2.

FIG. 8 shows a constructive form of the support for lifting by the wheels and by the underbody/underchassis 6, which appears to be formed by a structure with a flat plate, fitted with protections 6.4 at both ends, which in the first lifting step rotate on a pin with which they are equipped and brought to a safe position in order to prevent the wheels from coming off the plane of support for lifting by the wheels and by the underbody/underchassis 6 and the consequent fall of the vehicle from the lifter; this type of support for lifting by the wheels and by the underbody/underchassis 6 can be combined with the low elements 15 for support by the underbody/underchassis visible in FIG. 10, or high elements 13 visible in FIG. 7, or high with adjustable legs 14 visible in FIG. 9 or the simpler shape 11 visible in FIG. 8, each suitable for lifting different vehicles of small or medium size such as cars, commercial vehicles, vans, SUVs, pick-ups and others.

FIG. 9 shows a constructive variant of a high element with adjustable legs 14 for support by the underbody/underchassis, which is constituted of one side which supports the underbody/underchassis of the vehicle 14.5, slip-proof and preferably rubber, adjustable in height by means of a device equipped with a threaded pin 14.1, which is screwed into the intermediate body 14.2, fitted with two or more legs, of which at least one 14.3 is adjustable in length, each having one or more contact points 14.4, each consisting of slip-proof parts 14.6, preferably rubber, which are in contact on the support for lifting by the wheels and by the underbody/underchassis 6.

FIG. 10 shows a constructive variant of lower elements 15 for support by the underbody/underchassis which are constituted by a slip-proof part 15.4, preferably rubber, supporting the underbody/underchassis of the vehicle, adjustable in height by means of a device equipped with a threaded pin 15.1 which is screwed into the intermediate body 15.2, in turn equipped below with a contact element 15.3, fitted with a slip-proof part 15.5, preferably rubber, for contact on the support for lifting by the wheels and by the underbody/underchassis 6.

Figure 11:
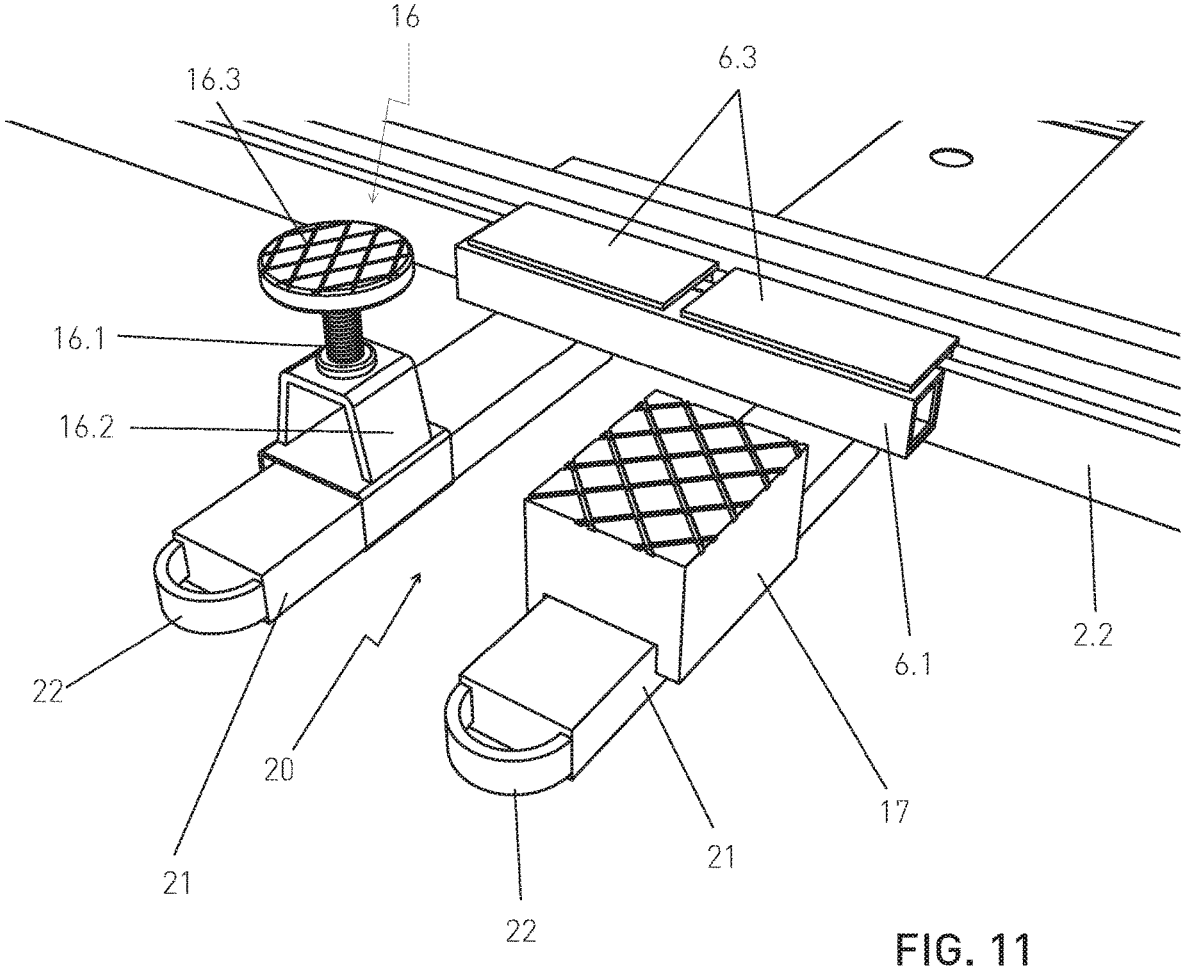
FIG. 11 shows a perspective view of the support for lifting by the wheels and by the underbody/underchassis 20 in a constructive version formed by two or more projecting shelves 21 with respect to the upper platform/framework 2 of the lifter, fitted with an element for support by the underbody/underchassis 16 adjustable in height and with the element for support by the underbody/underchassis of a simpler shape 17, applied to the shelves of the support for lifting by the wheels and by the underbody/underchassis.

FIG. 11 shows a further constructive form of the support for lifting by the wheels and by the underbody/underchassis 20, which appears to consist of a structure composed of a pair of projecting shelves 21, located at a certain distance from each other and fitted at each end with a handle 22, which is used for moving the support for lifting by the wheels and by the underbody/underchassis 20; in particular two constructive variants can be noted of elements for support by the underbody/underchassis, one of which is adjustable in height 16 and of a simpler shape 17, for the application to the support for lifting by the wheels and by the underbody/underchassis 20 in shelves. In this constructive variant the support of the vehicle is obtained by arranging the wheel of the vehicle itself between the pair of shelves 21.

Figure 12:
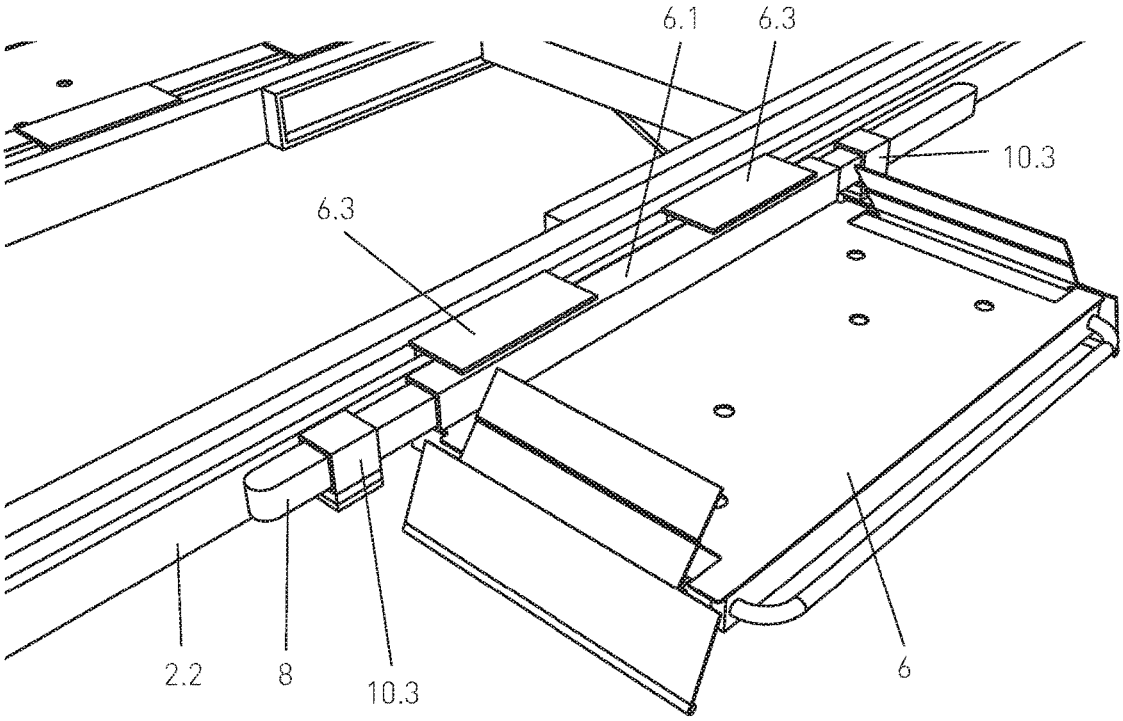
FIG. 12 shows a perspective view of the support for lifting by the wheels and by the underbody/underchassis 6 with the element 8 to which equipment can be applied as necessary with a pushing/pulling arm and anchoring clamps with the accessories thereof.

FIG. 12 shows a support for lifting by the wheels and by the underbody/underchassis with the sliding element 8 applied to the tubular profile 6.1 of the structure of the support for lifting by the wheels and by the underbody/underchassis 6, on which the blocking supports 10.3 are applied, which make it possible to firmly block both the sliding element 8 to the tubular profile 6.1 and the support for lifting by the wheels and by the underbody/underchassis 6 to the side profile 2.2 of the upper platform/framework 2.

Figure 13:
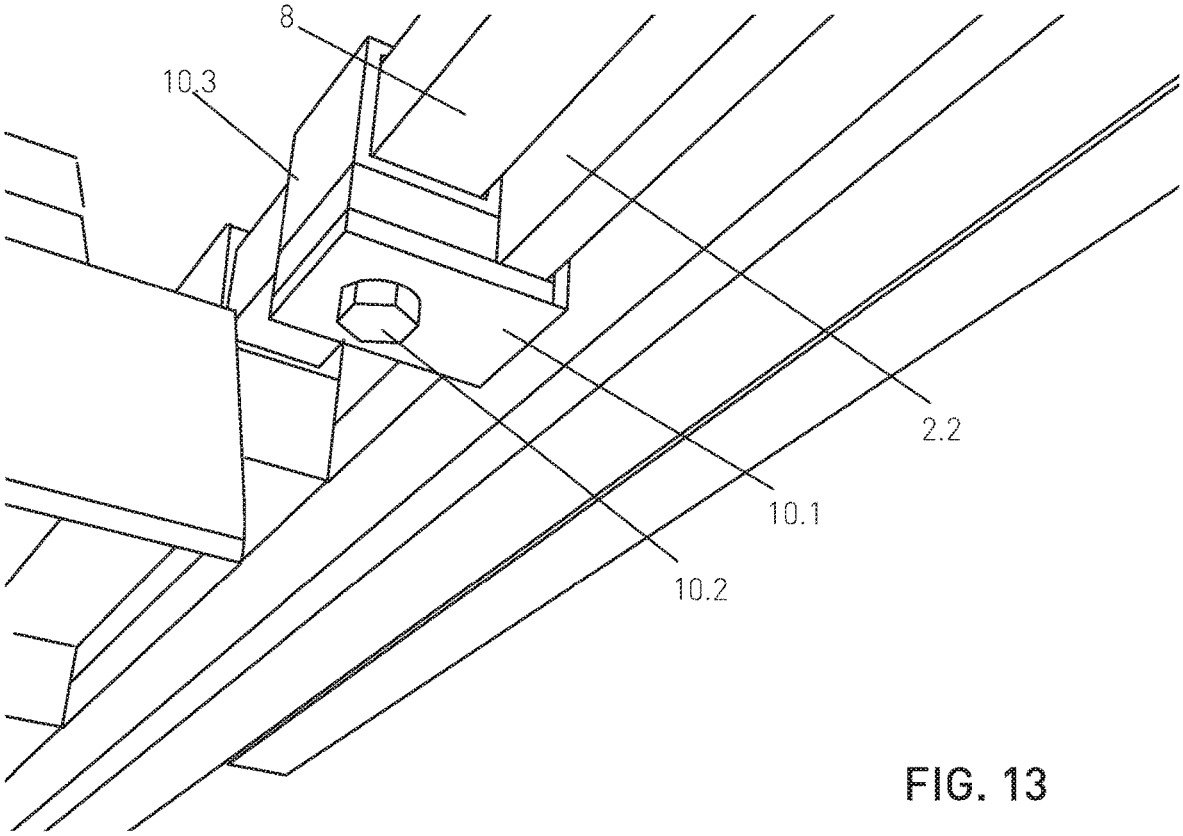
FIG. 13 shows a perspective view of the fixing of the application of the element 8 by means of the blocking support 10.3) and the blocking screw 10.2.

FIG. 13 shows the blocking system of the device which allows solidly blocking the sliding element 8 to the tubular profile 6.1, as indicated in FIG. 12, wherein the support for lifting by the wheels and by the underbody/underchassis 6, is blocked to the edges of the side profile 2.2 of the upper platform/framework 2 by means of the bracket 10.1, which is fixed to the body of the support 10.3 by means of a screw 10.2.

Figure 14:
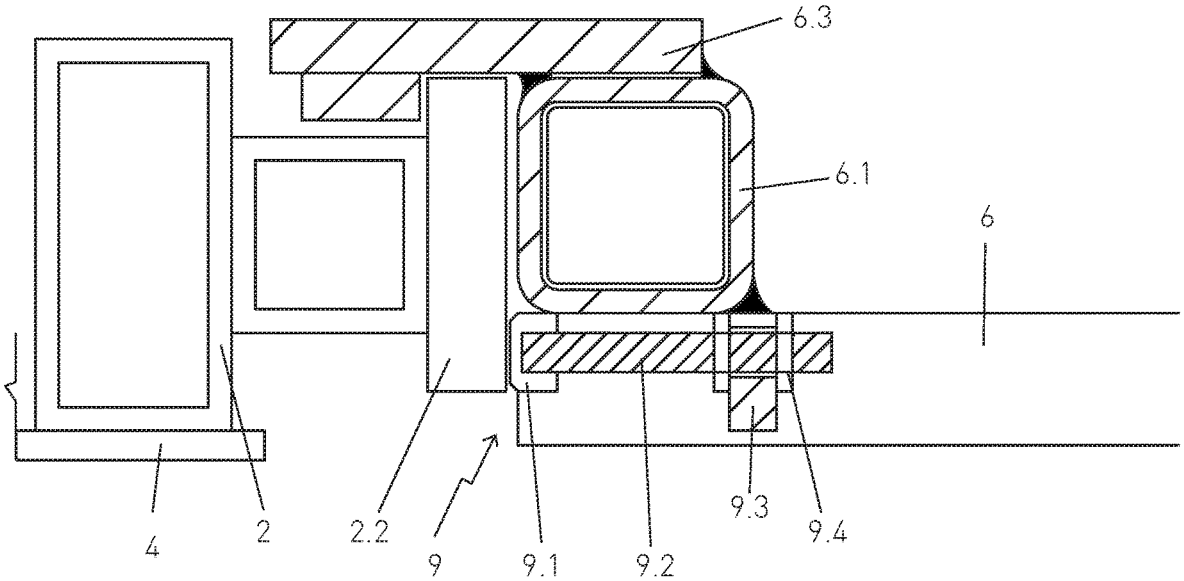
FIG. 14 shows a section view of the support for lifting by the wheels and by the underbody/underchassis 6, hooked to the perimeter structure of the upper platform/framework 2, which provides a device 9 for adjusting their inclination formed by an adjustment element 9.1, a threaded bar 9.2 and nuts for blocking 9.4 to the element 9.3.
Figure 16:
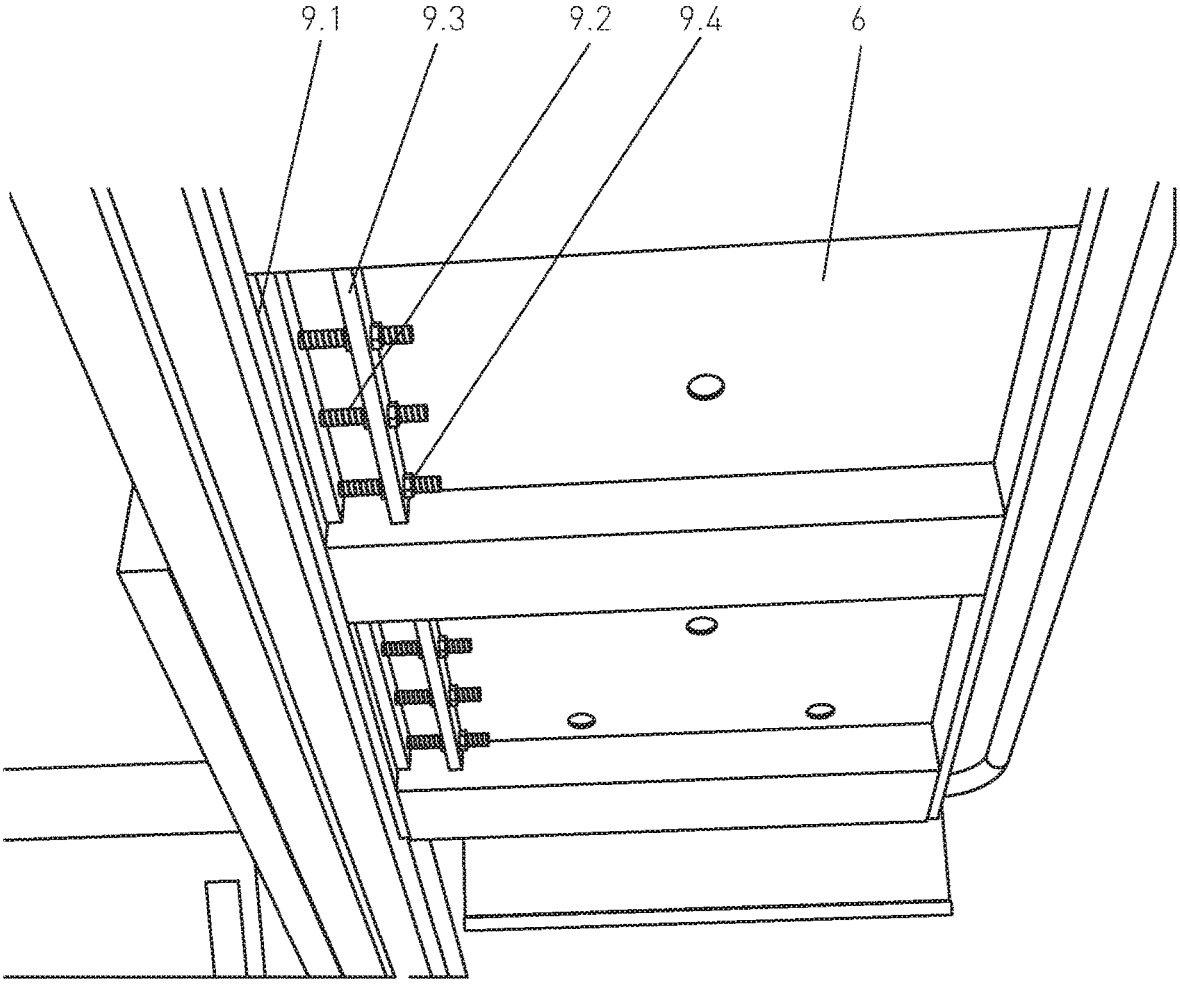
FIG. 16 shows a perspective view of the device for adjusting 9 the inclination of the support for lifting by the wheels and by the underbody/underchassis 6, consisting of the adjustment element 9.1, the threaded bar 9.2 and the nuts for blocking 9.4 to the element 9.3.

FIG. 14 shows a device for adjusting 9 the support for lifting by the wheels and by the underbody/underchassis 6, realized by means of the shaped plate 6.3 which engages in the side profile 2.2 of the upper platform/framework 2; the blocking is guaranteed by the integral support of the inner end of the plate 6.3 of the support for lifting by the wheels and by the underbody/underchassis 6 on the profile 2.2 of the upper platform/framework 2; the setting system 9, consisting of the element 9.1, the bar 9.2 and the element 9.3, integral with the tubular profile 6.1, allows adjusting the inclination of the support for lifting by the wheels and by the underbody/underchassis 6, also visible in perspective in FIG. 16.

Figure 15:
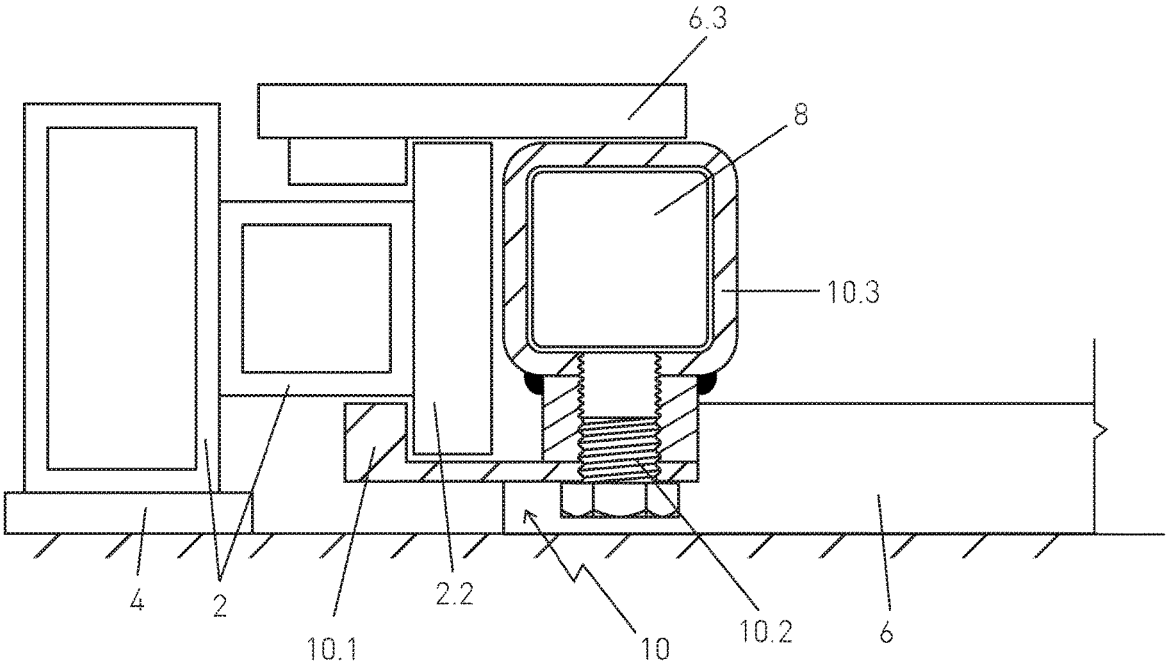
FIG. 15 shows a section view of the blocking device 10 of the support for lifting by the wheels and by the underbody/underchassis 6 by means of the blocking support 10.3 and blocking to the side profile 2.2 of the upper platform/framework 2 by means of the screw 10.2, which also blocks the movement of the element 8 with respect to the profile of the support for lifting by the wheels and by the underbody/underchassis 6.

FIG. 15 shows the blocking device 10 of the support for lifting by the wheels and by the underbody/underchassis 6 by means of the bracket 10.1, consisting of a shaped plate, which is solidly blocked to the side profile 2.2 of the upper platform/framework 2 by means of the screw 10.2.

FIG. 16 shows the device for adjusting 9 the inclination of the support for lifting by the wheels and by the underbody/underchassis 6, which comprises one or more elements 9.3, welded to the lower part of the structure of the support for lifting by the wheels and by the underbody/underchassis 6 and with holes to allow the setting and blocking of one or more threaded bars 9.2, which are moved inside the holes and blocked by a pair of nuts 9.4; the setting is obtained by means of the threaded bars 9.2, which are screwed into or welded onto one or more elements 9.1, which rest on the inner lower part of the side profiles 2.2 of the upper platform/framework 2; the combined action on the two nuts 9.4 allows obtaining the correct and desired inclination of the support for lifting by the wheels and by the underbody/underchassis 6.

Figure 17:
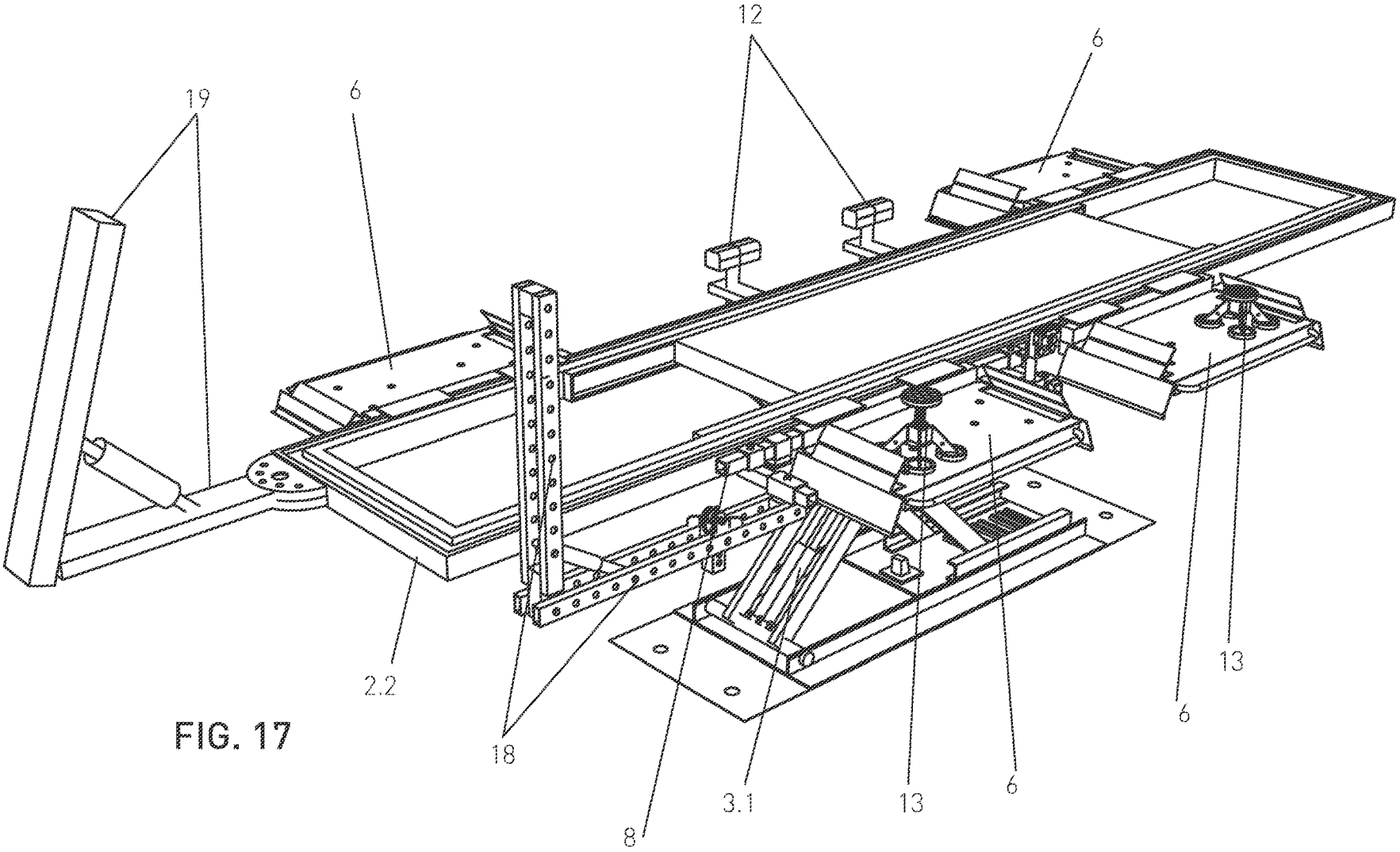
FIG. 17 shows a perspective view of the application of two versions of the pushing, pulling and fixing equipment which are used, when necessary, if the vehicle must be fixed to the clamps and straightened with the use of a pulling arm: the first with a pushing/pulling arm 18, an anchoring clamp, fixed to the element 8 of the support for lifting by the wheels and by the underbody/underchassis 6; the second with a pushing/pulling arm 19, fixing clamps 12, fixed on the upper platform/framework 2, on which are applied the four supports for lifting by the wheels and by the underbody/underchassis 6.

In FIG. 17 two different types of pulling and anchoring equipment are shown which, if necessary, are used if the vehicle has to be fixed to the clamps and straightened with the use of a pulling arm: the first is pulling and anchoring equipment suitable for small repairs, consisting of a pushing/pulling arm 18, with relative fixing clamps, applied to the support for lifting by the wheels and by the underbody/underchassis 6 by means of the element 8; the second is pulling and anchoring equipment adapted to large repairs, consisting of a pushing/pulling arm 19, with relative fixing clamps 12, applied to the side profile 2.2, which is applied along the perimeter of the upper platform/framework 2, on whose side are applied the supports for lifting by the wheels and by the underbody/underchassis 6.

Figure 18:
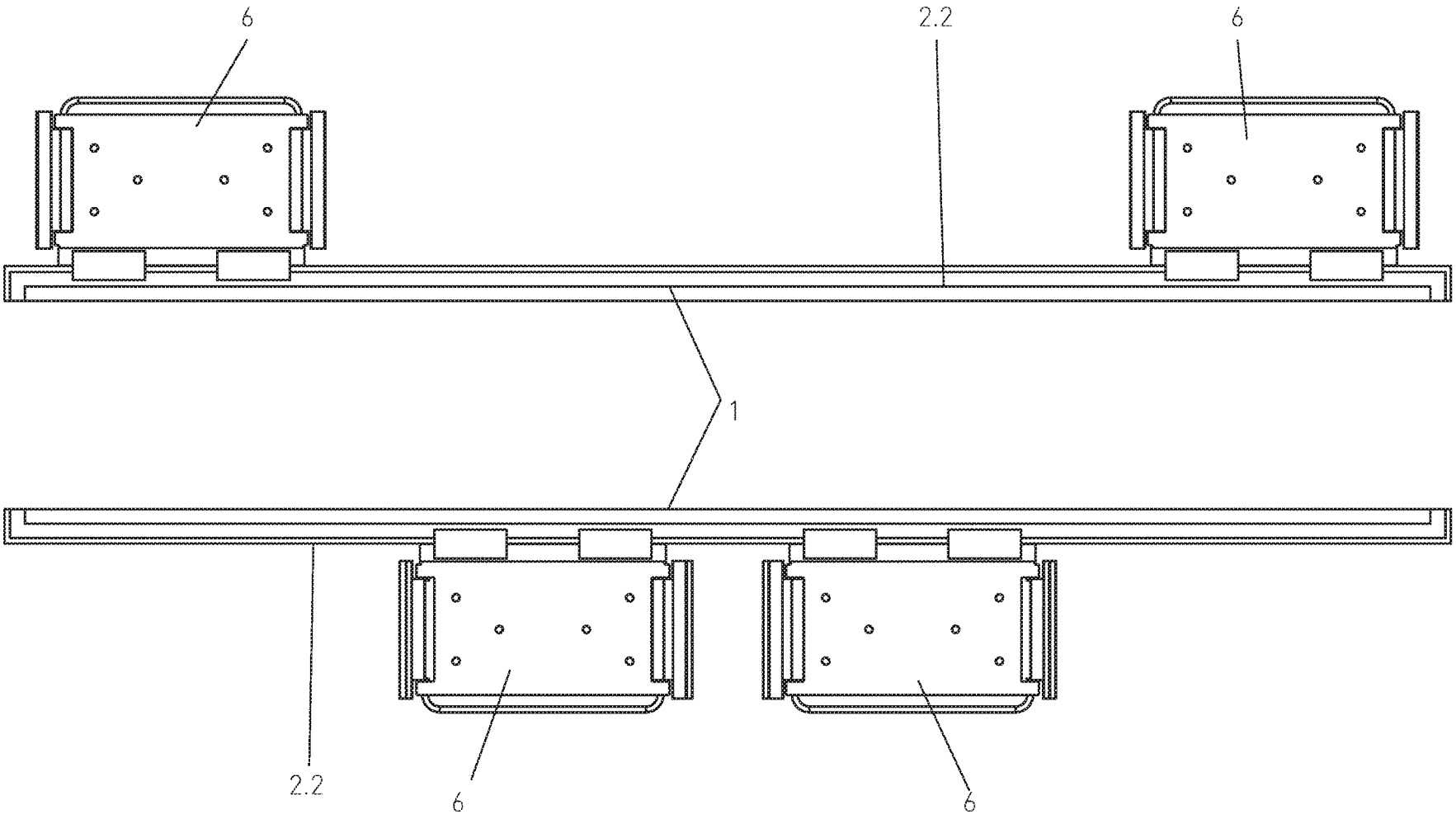
FIG. 18 shows a plan view of a lifter of the type with two independent lifting platforms—with recessed cylinders or with scissor or parallelogram levers—of different shapes, with the four supports for lifting by the wheels and by the underbody/underchassis 6.

FIG. 18 shows a lifter of the type with two independent lifting platforms (1)—with recessed cylinders or with scissor or parallelogram levers—of different shapes, with four supports for lifting by the wheels and by the underbody/underchassis 6 applied.

From the description of the figures above it is possible to understand the advantages of the invention thanks to the possibility of using the same supports for lifting by the wheels and by the underbody/underchassis 6 which are applied in a removable/movable manner to the upper platform/framework 2 and are moved by the operator along the side profiles 2.2 of the upper platform/framework 2 to be used to lift the vehicle both by the wheels and by the underbody/underchassis with consequent free wheels of the vehicle.

The possibility of performing these operations in lifting the vehicle by the underbody/underchassis and with free wheels is obtained using the elements for support by the underbody/underchassis of the low type 15, or high type 13 and 14, which are interposed between the underbody or underchassis of the vehicle and the support for lifting by the wheels and by the underbody/underchassis 6. The elements for support by the underbody/underchassis 13, 14, 15 which are in contact on the respective supports for lifting by the wheels and by the underbody/underchassis 6 by means of elements 13.3, 14.4, 15.3 fitted at the bottom with a slip-proof layer 13.5, 14.6, 15.5, preferably rubber and fitted with devices with threaded pins 131, 14.1 and 15.1, which support the vehicle being screwed into the respective intermediate bodies 13.2, 14.2, 15.2, adjustable in height and fitted at the top with slip-proof parts 13.4, 14.5, 15.4, preferably rubber; elements for support by the underbody/underchassis are also provided in a single block of slip-proof material, respectively suitable for being positioned on the respective supports for lifting by the wheels and by the underbody/underchassis 6 and on the shelves 21 of the support for lifting by the wheels and by the underbody/underchassis 20.

The possibility of being able to use, in all working conditions, the supports for lifting by the wheels and by the underbody/underchassis 6 in combination with the pushing, pulling and fixing equipment, equipped with a pushing/pulling arm 18, with anchoring clamp, is obtained by blocking the element 8 to the side profile 2.2 of the upper platform/framework 2 by means of the bracket 10.1 which is fixed to the body of the support 10.3 by means of a screw 10.2; in this way the blocking of the sliding of the element 8 to the tubular profile 6.1 of the supports for lifting by the wheels and by the underbody/underchassis 6 is also obtained.

In one constructive form the structure of the support for lifting by the wheels and by the underbody/underchassis 20 consists of a pair of projecting brackets 21, fitted at each end with a handle 22, which is used for moving the support for lifting by the wheels and by the underbody/underchassis 20. In this constructive form the support of the vehicle is obtained by means of elements for support by the underbody/underchassis 16, which are externally inserted into the shelves 21 of the supports for lifting by the wheels and by the underbody/underchassis 20, and are adjustable in height by means of a support with a threaded pin 16.1, which is screwed into the intermediate body 16.2 and which are fitted at the top with a slip-proof part 16.3, preferably rubber for the support of the vehicle. In this constructive form the vehicle is supported by the wheels, arranging each wheel of the vehicle between the shelves 21.

The fixing of the support for lifting by the wheels and by the underbody/underchassis 20 to the upper platform/framework 2 is obtained by means of the bracket 10.1, fixed to the body of the support 10.3 by means of a screw 10.2; in this way it is possible to use in all working conditions the supports for lifting by the wheels and by the underbody/underchassis 20 to shelves, the pushing/pulling equipment 18 with fixing clamps, fixed on the element 8 when installed in the support for lifting by the wheels and by the underbody/underchassis 20.

The peculiarity of the device for adjusting 9 the inclination of the support for lifting by the wheels and by the underbody/underchassis 6 consists in obtaining the adjustment by acting on the two nuts 9.4, which block the movement of the threaded bar 9.2 by applying a force on the element 9.1, resting on the lower part of the side profiles 2.2 of the upper platform/framework 9.1; in this way the parallelism or an inclination of the supports for lifting by the wheels and by the underbody/underchassis 6 with respect to the upper platform/framework 2 is obtained.

Figure 19:
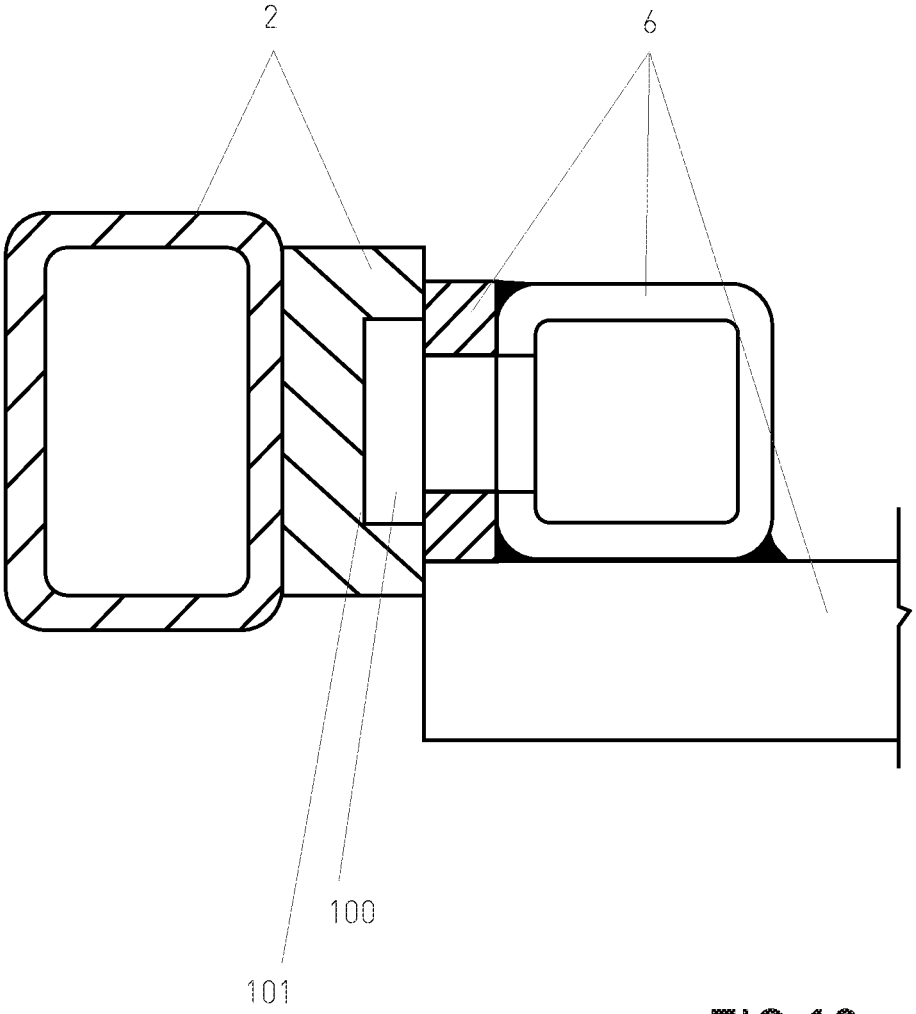
FIG. 19 shows in section a constructive form for hooking the supports for lifting by the wheels and by the underbody/underchassis 6 to the upper platform/framework 2 of known type, by means of a pin fixed to the element of the support for lifting by the wheels and by the underbody/underchassis 6, which slides into a slit formed in the structure of the platform/framework 2.

To make the novelty of the invention more evident, FIG. 19 shows a diagram of how in the state of the art the support for lifting by the wheels and by the underbody/underchassis 6 is hooked to the upper platform/framework 2 of a known type, i.e. simply by means of a pin or plate 100 fixed to the element of the support for lifting by the wheels and by the underbody/underchassis 6 and which slides in a slot 101 formed in the structure of the aforementioned platform/framework 2. In a further constructive form, the support for lifting by the wheels and by the underbody/underchassis 6 is engaged on holes or seats present in the upper platform/framework 2 so that the operator must unhook and re-hook the support for lifting by the wheels and by the underbody/underchassis 6 for movement.

Further constructional forms of the support for lifting by the wheels and by the underbody/underchassis 6 are also envisaged, of the hooking type of the support for lifting by the wheels and by the underbody/underchassis 6 of the upper platform/framework and the elements for support by the underbody/underchassis, provided that everything falls within the inventive concept defined by the following claims.

What is claimed is:

1. A vehicle lifting equipment for vehicles comprising:

a central lifter composed of an upper platform/framework, fixed to a lifting mechanism, connected to the floor directly or by means of a resting base, and actuated by at least one actuator which allows bringing said upper platform/framework to the desired height, and supports for lifting by the vehicle wheels applied on side profiles of the upper platform framework, which allow the vehicle itself to be lifted and lowered by means of the lifter wherein said supports for lifting by the wheels become the same supports for lifting by the wheels and by an underbody/underchassis used to lift the vehicle by the wheels or alternatively by the underbody/underchassis, using a combination of support elements for support by the underbody/underchassis, interposed between the supports for lifting by the wheels and by the underbody/underchassis and the underbody/underchassis of the vehicle, said supports for lifting by the wheels and by the underbody/underchassis being applied in a removable/movable way to the upper platform/framework and being also equipped with a device for adjusting their inclination by means of a bracket element that rests on the wall of the lower part of the side profile of the upper platform/framework.

2. The vehicle lifting equipment according to claim 1, wherein, the device for adjusting their inclination further comprises one or more brackets welded to a lower part of the support for lifting by the wheels and by the underbody/underchassis, equipped with one or more holes so that one or more threaded bars can each move inside its own hole for the adjustment, which is obtained by means of a pair of nuts, being the threaded bar screwed into or welded onto the bracket element that rests on the wall of the lower part of the side profile of the upper platform/framework, while the pair of nuts allows for the correct inclination of the support for lifting by the wheels and by the underbody/underchassis.

3. The vehicle lifting equipment according to claim 1, wherein the supports for lifting by the wheels and by the underbody/underchassis have a flat shape on the upper contact surface of the wheels of the vehicle and/or of the support elements for support by the underbody/underchassis.

4. The vehicle lifting equipment according to claim 1, wherein the supports for lifting by the wheels and by the underbody/underchassis are each formed by at least two shelves perpendicularly arranged with respect to the side profile of the upper platform/framework.

5. The vehicle lifting equipment according to claim 1, wherein the supports for lifting by the wheels and by the underbody/underchassis have a shaped element on an outer part for moving the supports for lifting by the wheels and by the underbody/underchassis.

6. The vehicle lifting equipment according to claim 1, further comprising anchoring clamps and a pushing and/or pulling arm, wherein the upper platform/framework fitted with the supports for lifting by the wheels and by the underbody/underchassis is suitable for use with the anchoring clamps and the pushing and/or pulling arm for large repairs used on large benches, all fastened to the side profiles or to front profiles of the upper platform/framework.

7. The vehicle lifting equipment according to claim 1, further comprising a blocking device comprising a blocking bracket, a blocking screw, and a blocking support, wherein, the supports for lifting by the wheels and by the underbody/ underchassis comprise tubular profiles and are fixed to the upper platform/framework, by means of the blocking screw, which blocks the blocking bracket to the blocking support, causing the downwards movement of a sliding element whose movement blocks the support for lifting by the wheels and by the underbody/underchassis, to the side profile of the upper platform/framework and simultaneously blocks the sliding element to the tubular profile of the support for lifting by the wheels and by the underbody/underchassis.

8. The vehicle lifting equipment according to claim 7, wherein each support for lifting by the wheels and by the underbody/underchassis in all the conditions of use is designed to support the fixing, pushing and/or pulling equipment, fixed to the sliding element or in other points of the support for lifting by the wheels and by the underbody/underchassis.

9. The vehicle lifting equipment according to claim 1, wherein the support elements for support by the underbody/underchassis are composed of an intermediate body fitted with an adjustable element comprising a threaded pin that is screwed or unscrewed to adjust its height, on whose upper part which supports the vehicle by the underbody/underchassis, a slip-proof material is placed, while on lower part contact elements on the support for lifting by the wheels and by the underbody/underchassis a slip-proof material is placed.

10. The vehicle lifting equipment according to claim 9, wherein the support elements for support by the underbody/underchassis comprise a combination of high support elements and low support elements, the low support elements being shorter than the high support elements and comprise slip-proof material formed on an upper part of the low support elements for support by the underbody/underchassis and are adjustable in height by means of a device fitted with a threaded pin that is screwed into the intermediate body, fitted on the bottom with contact elements, on whose part in contact with the support for lifting by the wheels and by the underbody/underchassis a slip-proof material is placed.

11. The vehicle lifting equipment according to claim 9, wherein the support elements for support by the underbody/underchassis comprise slip-proof material formed on an upper part of the support elements for support by the underbody/underchassis and are adjustable in height by means of a device fitted with a threaded pin that is screwed into the intermediate body, fitted on the bottom with contact elements, on whose part in contact with the support for lifting by the wheels and by the underbody/underchassis a slip-proof material is placed.

12. The vehicle lifting equipment according to claim 9, wherein the support elements for support by the underbody/underchassis comprise slip-proof material formed on an upper part of the support elements for support by the underbody/underchassis and are adjustable in height by means of a device fitted with a threaded pin, that is screwed into the intermediate body, to which one or more legs are fixed, of which at least one is adjustable in length, each leg being fitted on the bottom with one or more contact elements, on whose part in contact with the support for lifting by the wheels and by the underbody/underchassis a slip-proof material is placed.

13. The vehicle lifting equipment according to claim 9 wherein the support elements for support by the underbody/underchassis which are externally inserted into shelves of the supports for lifting by the wheels and by the underbody/underchassis, said support elements for support by the underbody/underchassis on the upper part of support/contact to the underbody/underchassis of the vehicle are made of slip-proof material and are adjustable in height by means of a device fitted with a threaded pin, which is screwed into the intermediate body.

* * * * *